United States Patent [19]

Andreasson

[11] 4,249,774

[45] Feb. 10, 1981

[54] INVALID CHAIR

[76] Inventor: Sven A. G. Andreasson, Pianogatan 50, S-421 44 Västra Frölunda, Sweden

[21] Appl. No.: 14,288

[22] Filed: Feb. 22, 1979

[51] Int. Cl.[2] ..... A47C 1/02

[52] U.S. Cl. ..... 297/311; 297/DIG. 10; 297/316; 297/330; 297/347

[58] Field of Search ..... 297/316, 320, 321, 330, 297/DIG. 10, 347, 311, 201; 4/185 R, 185 S; 5/81 R

[56] References Cited

U.S. PATENT DOCUMENTS

| | | | |
|---|---|---|---|
| 604,347 | 5/1898 | Bray | 297/201 |
| 1,288,216 | 12/1918 | Sayles | 297/DIG. 10 |
| 2,690,208 | 9/1954 | Mary | 297/DIG. 10 |
| 3,138,402 | 6/1964 | Heyl et al. | 297/330 X |
| 4,067,249 | 1/1978 | Deucher | 297/330 |
| 4,193,147 | 3/1980 | Fischer | 5/81 R |

FOREIGN PATENT DOCUMENTS

| | | | |
|---|---|---|---|
| 608542 | 9/1948 | United Kingdom | 297/316 |
| 998676 | 7/1965 | United Kingdom . | |

*Primary Examiner*—James T. McCall
*Attorney, Agent, or Firm*—Cushman, Darby & Cushman

[57] ABSTRACT

An invalid chair has a seat divided into a central saddle portion and a leg supporting portion. The saddle portion is rigidly connected with the backrest having two armrests. The leg supporting portion is hingedly connected at its front end to the base frame of the chair and a linkage is provided, so that when lifting the saddle portion it will leave the leg supporting portion and carry the person sitting on the saddle portion with his hands on the armrests until the legs of the person are substantially straightened out with his feet resting on the floor.

4 Claims, 7 Drawing Figures

INVALID CHAIR

The present invention relates to an invalid chair having a base frame supporting a partitioned seat and a backrest provided with a pair of armrests, the seat being connected to the base frame by means of a linkage and being raisable by means of power means from a normal lower position to an erected position to facilitate for a sitting person to rise from a seated position, or for a standing person to sit down.

Chairs for facilitating a person to rise from the chair are known from U.S. Pat. No. 1,288,216, 3,138,402, British Pat. No. 998,676 and Swedish Pat. No. 7306950-2. A common feature of these prior chairs is that the seat or a portion of the seat may be moved by means of power means from a lower position to a raised position to assist the person in rising from the chair. However, the known chairs will raise the person to a position where he will have only partial assistance of the chair when leaving the chair to obtain the final position, standing on his feet.

The object of the invention is to provide an invalid chair which will secure the invalid an improved safety assistance when rising from a seated position, or when sitting down.

This is obtained by means of a chair under consideration which according to the invention is characterised in that the seat is composed of a central saddle portion and a leg supporting portion pivotally movable relative to the saddle portion, that the saddle portion is rigidly connected to the backrest, and that the leg supporting portion is pivotally connected at its front edge portion with a part of the base frame and at its rear edge to parts rigidly connected with the backrest. As the backrest and saddle portion are raised by a power means, the leg supporting portion tilts downwardly and forwardly to allow the legs of a seated person to straighten out as his body is being lifted by the saddle portion. When the backrest and saddle portion reach their uppermost position the person will be in essentially a standing position, with his legs straddling the seat portion and his feet still on the floor. During all movements upwards or downwards, the person will all the time be able to have support from the backrest and the armrests and saddle portion, which gives the person the desired feeling of safety. The chair may easily be adjusted to the actual size of the person so that, when the saddle portion is in its maximum upper position, the person will be supported by the saddle portion in a substantially standing position with the feet on the floor. This means that the person can hold his hands on the armrests and with a small movement forwards leave the saddle portion in a practically upright, standing position.

A prototype of the chair according to the invention and two preferred embodiments, respectively, are shown by way of example in the accompanying drawings.

Figure 1:
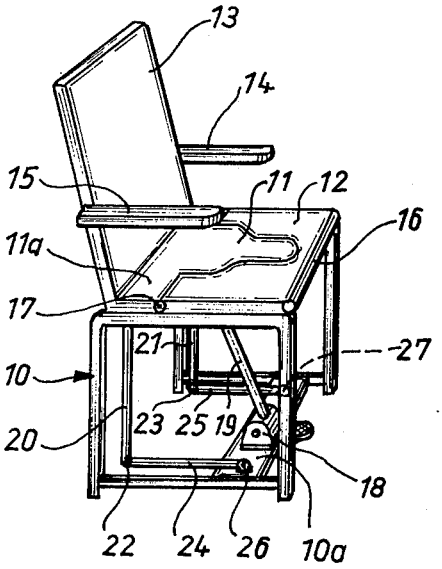
FIG. 1 is a diagrammatic perspective view of the prototype chair in a normal position.
Figure 2:
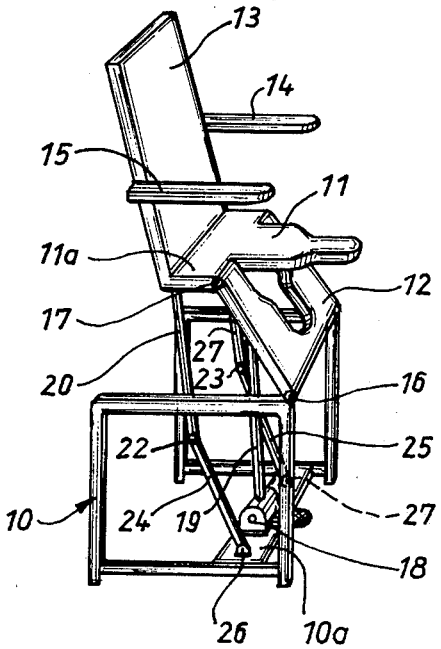
FIG. 2 is a perspective view of the prototype chair in a fully erected position.
Figure 3:
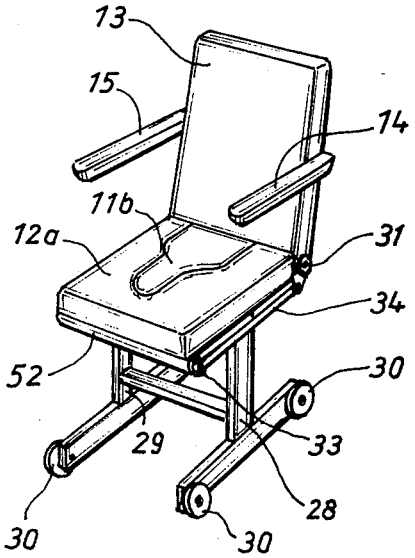
FIG. 3 is a diagrammatic perspective view of a second embodiment of the chair in a normal position.
Figure 4:
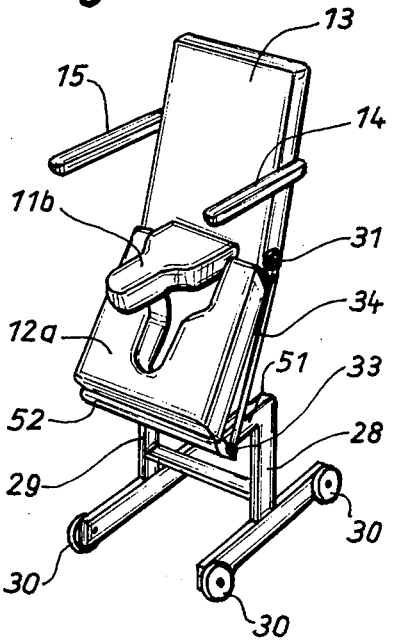
FIG. 4 is a perspective view of the chair in FIG. 3 in a fully erected position.

The prototype chair in FIGS. 1 and 2 has a base frame 10 supporting a partitioned seat which comprises a saddle portion 11 and a leg supporting portion 12, surrounding the saddle portion along its sides and front portion to form a substantially U-shaped portion.

The backrest 13 has two armrests 14,15. The saddle portion 11 is rigidly secured to the backrest.

The leg supporting portion 12 is hingedly connected at its front edge to the base frame 10 by means of a hinge 16.

At its rear ends the leg supporting portion 12 is hingedly connected by hinges 17 to the backrest 13 or a portion 11*a* secured to the backrest.

The base frame 10 has a cross-piece 10*a* supporting a reversible electric motor 18 driving a conventional screw jack 19, the motor being pivotally mounted on the cross-piece 10*a* and hingedly connected at its upper end to the bottomm side of the saddle portion 11.

In order to maintain a substantially horizontal position of the saddle portion 11 when raising it from the normal position in FIG. 1 to the erected position in FIG. 2, there is a linkage which comprises the following members. A pair of rods 20,21 extend from the backrest and are at their lower ends connected by pivot joints 22,23 with links 24,25 which at their front ends are connected by hinges 26,27 to the crosspiece 10*a*. Accordingly, the linkage will maintain the saddle portion in a substantially horizontal position. Should it be desired, however, to have the saddle portion inclined upwardly or downwardly in its erected position, this is easily obtained by adjusting the length of the arms in the linkage.

The electric motor is controlled by means of a switch mounted on one of the armrests.

As will be understood from FIG. 2, the person will be sitting on the saddle portion 11 with his legs positioned at the sides of the saddle portion and directed substantially vertically and substantially straightened out and resting with the feet on the floor. The person may have his hands on the armrests 14,15 and may further have support by the backrest. By leaning forwards and pushing against the armrests, the person will safely obtain a standing position free from the chair. Sitting down is performed in the reverse manner.

With reference to FIGS. 3 to 6, one preferred embodiment has a base frame comprising two T-shaped legs 28,29 having wheels 30.

The vertical portion of the legs is preferably telescopically adjustable to enable the chair to be adjusted to the length of the legs of the actual person.

The backrest 13 has two armrests 14,15 and is at its lower end secured to a transverse tube 31 to which is secured a bracket arm 32 (FIGS. 5 and 6) supporting the saddle portion 11*b* of the seat. The leg supporting portion 12*a* and the saddle portion 11*b* of the seat are slightly modified relative to the leg supporting portion 12 and saddle portion 11, 11*a* in FIG. 1.

The legs 28,29 have at their upper ends a bracket arm 51 secured to a front bar 52.

At each end of the bar 52 there is a pair of lugs 33 to support a pivot 33*a* for pivotally connecting an upper link 34 having its rear end pivotally connected by a pivot 35*a* with a pair of lugs 35 on the tube 31. The length of the upper links 34 is adjustable.

Substantially at the middle of the front bar 52 there is a lower pair of lugs 36 to support a pivot 36*a* for pivotally mounting the electric motor 18, its gearbox 18*a* and the screw jack 19 having its upper end pivotally connected with a pivot 37*a* supported by a pair of lugs 37 on the tube 31.

A lower link 38 has its front end connected by a pivot 39*a* supported by a pair of lower lugs 39 on the front bar 52 and is connected at its rear end by a pivot 40*a* to a pair of lever arms 40.

Figure 5:
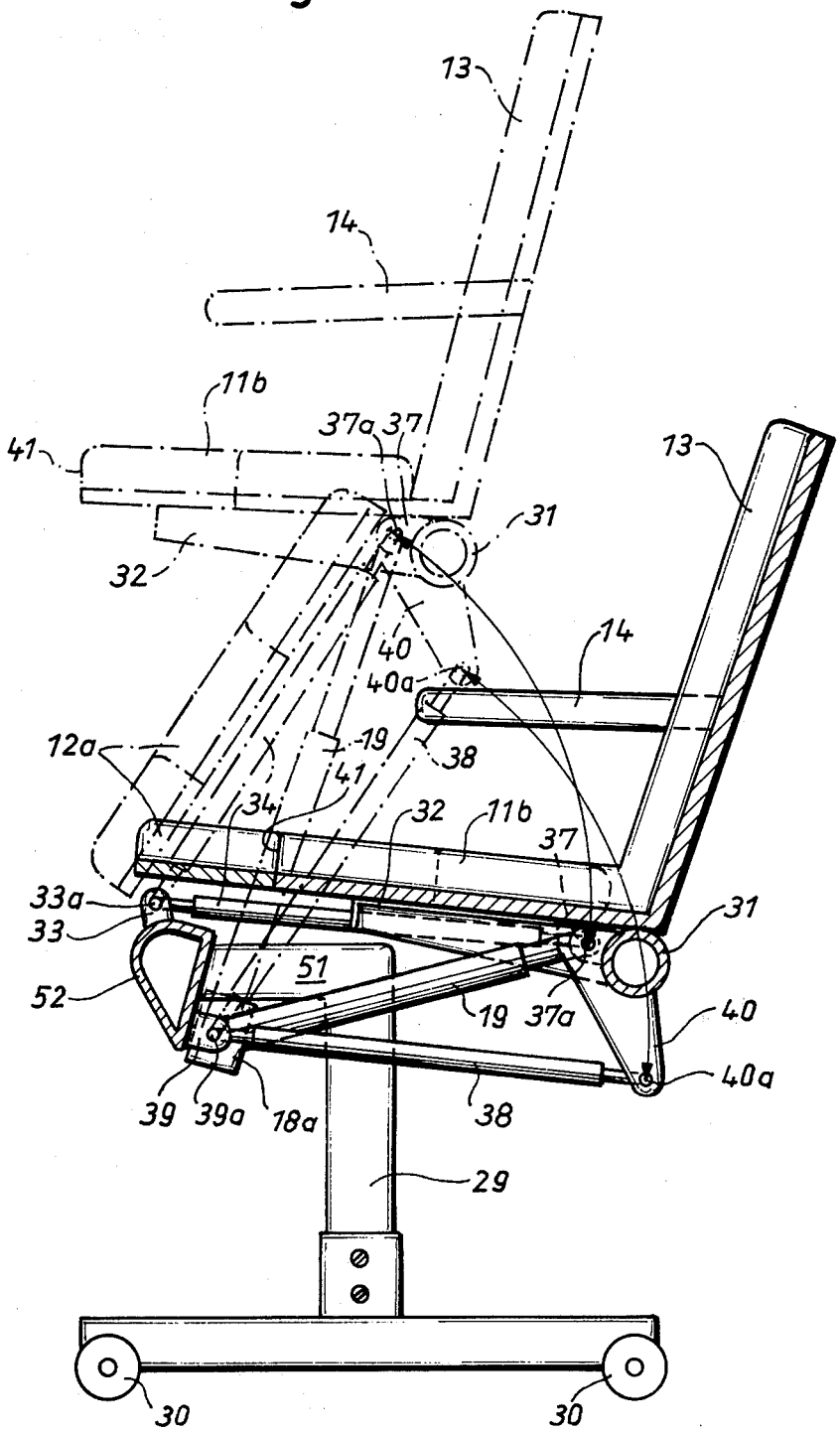
FIG. 5 is a diagrammatic longitudinal section through the chair shown in solid lines for the normal position in FIG. 3 and in dotted lines for the erected position in FIG. 4.

The linkage system having its hinge points at the four pivots 33*a*,35*a*,39*a* and 40*a* may form a parallellogram or may be adjustments of the lengths of the links deviate more or less from the parallellogram so that the saddle portion 11*b* may be substantially horizontal or inclined downwardly to a desired degree in relation to the position shown in FIG. 5.

Figure 6:
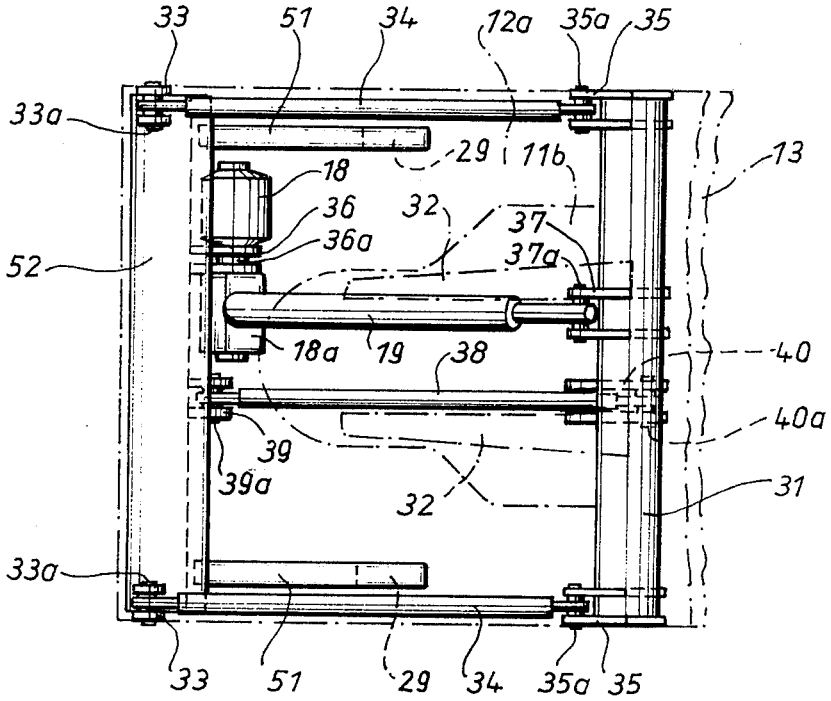
FIG. 6 is a plan view of the base frame and linkage system of the chair, with the backrest and seat shown in phantom.

The function of the chair in FIGS. 5 to 6 is the same as in FIGS. 1 and 2, but the main advantage is that the linkage system is concentrated in the space closely below the seat so that, if desired, it can easily be concealed by means of a cover plate at the sides of the seat.

Although not shown, there may be a pair of compression springs or a pair of gas-operated spring members mounted to assist the screw jack 19, so that the electric motor can have a relatively small power for moving the linkage system.

Figure 7:
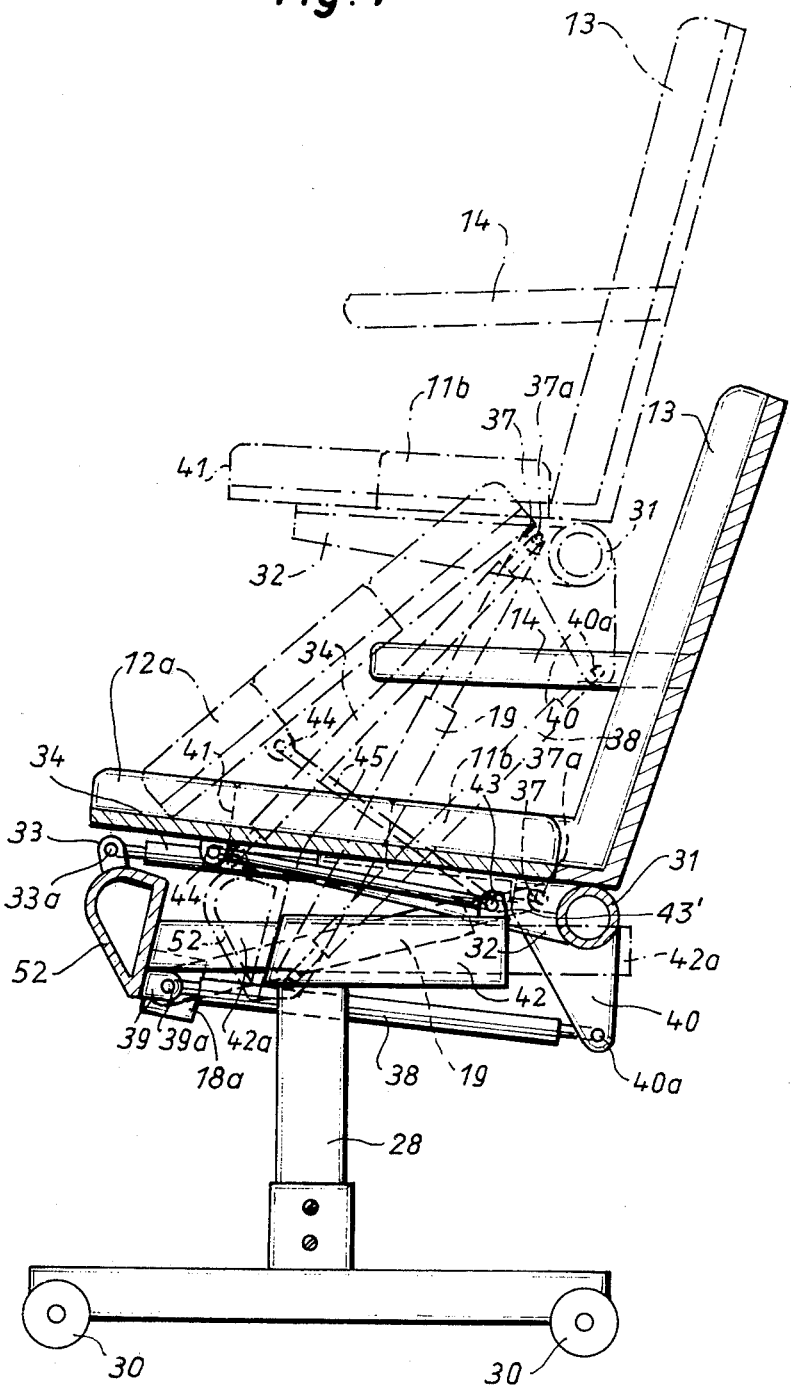
FIG. 7 is a diagrammatic longitudinal section of a third embodiment shown in a normal position and in dotted lines in an erected position.

As will be seen from FIGS. 7 and 5, the front edge 41 of the saddle portion 11*b* has the same position in the normal position, whereas in the erected position the front edge 41 in FIG. 5 has been moved forwards a distance equal to about the length of the saddle portion 11*b*. This results in a decreased stability which could be compensated by extending the base of the frame, so that the front wheels 30 will be positioned well ahead of the chair which in turn will require more free space on the floor for turning the chair around.

In contrast, in FIG. 7 the front edge 41 will be moved along a substantially vertical path which means that the position of the centre of gravity of the person will remain practically constant in its position between the forward and rearward wheels 30 of the base frame. This is simply obtained by having two shafts 42*a* slidably mounted each in a bushing 42 which is fixed and supported by the respective leg 28 and 29, the forward end of each shaft being secured to the front bar 52 so that this may be moved from its forward position shown in FIG. 7 to its rearward position shown by dotted lines in FIG. 7. This movement is obtained by means of a link 43 for each bushing 42*a*, the link being hingedly connected to a pair of lugs 43' on the rear end of the bushing, and a pair of lugs 44 on the bottom side of the leg supporting portion 12*a*. When the rear end of the portion 12*a* is swung up by pivoting at 33*a*, the links 43 will be swung to the position shown by dotted lines, thereby urging the front end of the leg supporting portion and thus the front bar 52 to move backwards to the position shown by dotted lines.

What I claim is:

1. An invalid chair for facilitating a sitting person to stand and a standing person to sit comprising: a floor-engaging base frame; an upright backrest; armrests carried by said backrest; a seat having a saddle portion connected to said backrest so as to extend forwardly and generally horizontally therefrom, said seat also having a generally U-shaped leg-supporting portion, the contour of the interior of the U being generally complementary to said saddle portion and the legs of the U pointing toward said backrest; means pivotally mounting the ends of the legs of the U about an axis fixed with respect to said backrest, such that said seat portion is swingable in a vertical plane relative to said backrest and saddle portion; and power means connected between said base frame and said backrest and saddle portion for raising and lowering said backrest and saddle portion relative to said base frame whereby said leg supporting portion swings between a first position generally coextensive with said saddle portion when said backrest and saddle portion are in a lowered position and a second position inclined downwardly and forwardly with respect to said backrest and saddle portion when said backrest and saddle portion are in a raised position.

2. A chair as in claim 1 wherein said base frame includes a front bar to which is hinged a pair of upper links and at least one lower link, said links being at their opposite end connected with the lower end of said backrest, said links forming substantially a parallellogram linkage.

3. A chair as in claim 2 wherein said front bar is secured to the front ends of two substantially horizontal shafts which are slidable in two substantially horizontal bushings, said bushings being connected with said leg supporting portion by means of links which urge said front bar rearwardly when said leg supporting portion swings from its first position towards its second position.

4. An invalid chair comprising: a floor-engaging base frame assembly; a backrest assembly disposed above said frame assembly, said backrest assembly including a backrest portion and a saddle extending forwardly and generally horizontally from said backrest portion; a generally U-shaped leg-supporting assembly disposed forwardly of said backrest portion and having a front edge and rearwardly extending legs; means including a linkage assembly pivotally interconnecting said leg-supporting assembly and said base frame assembly for allowing said backrest assembly to move between an up position and a down position relative to said base frame assembly and simultaneously for pivoting said leg-supporting assembly between a first position generally coextensive with the straddling said saddle and a second position inclined downwardly and forwardly with respect to said saddle.

* * * * *